United States Patent [19]

Thompson et al.

[11] 4,403,870

[45] Sep. 13, 1983

[54] WATER-RESISTANT SHAPED CASE CONSTRUCTION FOR A WRISTWATCH

[75] Inventors: Harwell B. Thompson, Cheshire; Paul Wuthrich, Watertown, both of Conn.

[73] Assignee: Timex Corporation, Waterbury, Conn.

[21] Appl. No.: 338,762

[22] Filed: Jan. 11, 1982

[51] Int. Cl.[3] ..... G04B 37/00; G04B 39/00

[52] U.S. Cl. ..... 368/294; 368/280; 368/286; 368/291; 368/309

[58] Field of Search ..... 368/289, 291, 286, 296, 368/280, 276, 287, 292, 294, 295, 309

[56] References Cited

U.S. PATENT DOCUMENTS 2,735,259 2/1956 Gisiger ..... 368/291

2,845,773 8/1958 Sakalys ..... 368/286

3,719,038 3/1973 Klingenberg ..... 368/280

*Primary Examiner*—J. V. Truhe

*Assistant Examiner*—Terrance L. Flower

*Attorney, Agent, or Firm*—William C. Crutcher

[57] ABSTRACT

A water-resistant shaped case construction for a wristwatch with a bell-shaped molded crystal with a central viewing portion and a depending wall forming part of the case including an integral pendant for the stem, a stainless steel bezel shell clamping a sealing gasket between the rim of the crystal wall and the caseback by a snap-fit attachment between the bezel and the case back. The improvements include a shoulder on the crystal wall cooperating with the rim of the caseback to control the clamping action on the gasket.

7 Claims, 8 Drawing Figures

WATER-RESISTANT SHAPED CASE CONSTRUCTION FOR A WRISTWATCH

This invention relates generally to case constructions for timepieces, and more particularly to a water-resistant case construction for a wristwatch of the type having a bell-shaped crystal and caseback forming a housing for the movement or module, with a bezel surrounding the crystal wall and clamping the members together.

A conventional wristwatch constuction generally includes a case, a crystal for viewing the hands or timepiece display, and a caseback, these three members together forming an enclosure which may or may not be water-resistant. The ability to mold shaped transparent crystals has led to some uses of bell-shaped crystals, wherein a depending wall is formed integrally with the central viewing portion of the crystal, the wall then being attached to other members to form the enclosure. These molded crystal wall portions are susceptible to cracking or breakage when stresses are imposed upon them if they are not properly supported. This tendency is accentuated in the case of a non-circular crystal. It is known to incorporate the pendant for receiving the stem of the winding crown or push button as an integral portion of the bell-shaped crystal wall. It is also known that compressible gaskets can be clamped between various members of the housing to ensure that the housing will be water resistant. Examples of the aforementioned prior art are seen in the following U.S. patents which are exemplary;

2,256,200, D. J. Heilman, Sept. 16, 1941;
3,719,038, H. U. Klingenberg, Mar. 6, 1973;
2,735,259, A. Gisiger, Feb. 21, 1956;
2,719,403, A. Gisiger, Oct. 4, 1955;
2,308,189, F. Marti, Jan. 12, 1943;
2,845,773, V. Sakalys, Aug. 5, 1958.

Of the aforecited patents, the Gisiger U.S. Pat. No. 2,735,259 includes a bell-shaped crystal without a sealing gasket, the crystal being snap-fit to the caseback and the bezel being snap-fit to the crystal. The Sakalys U.S. Pat. No. 2,845,773 has a sealing gasket clamped between a conventional (not bell-shaped) crystal and a watch case by means of a bezel clamped against an upper shoulder of the crystal and a snap-fit attachment between the bezel and the housing, and having no means to control the clamping movement against the gasket other than the reaction of the compressed gasket.

Along with water-resistance, it is desirable to have an inexpensive case construction of corrosion-resistant materials such as stainless steel or plastic. While stainless steel cases are expensive if the entire case is constructed of this material, stainless steel may be formed in thin shells for covering other, less expensive corrosion-resistant materials such as plastic. This gives the appearance of a stainless steel case at lower cost. Difficulties have been encountered with breakage of the plastic portions of such constructions when attempting to provide water-resistance, because of the stresses necessary to create a tight seal.

Accordingly, one object of the present invention is to provide an improved water-resistant case construction for a timepiece with a bell-shaped crystal and a covering bezel snap-fit to the caseback.

Another object of the invention is to provide an improved case construction for a shaped plastic and stainless steel case combination which is economical to produce.

Still another object of the invention is to provide an improved case construction using a bell-shaped plastic, crystal with improved sealing means and less susceptible to cracking due to stresses on the crystal.

DRAWINGS

The invention, both as to organization and method of practice, together with further objects and advantages thereof, will best be understood by reference to the following specifications, taken in connection with the accompanying drawings, in which.

SUMMARY OF THE INVENTION

Briefly stated, the invention comprises the improvement in a wristwatch of the type having a bezel snap-fit to a caseback, the bezel surrounding portions of a bell-shaped crystal with a central viewing portion and a wall portion with integral pendant, the improvement comprising a sealing gasket clamped between the rim of the integral crystal wall and the caseback by means of oppositively-directed axially-facing clamping and movement limiting respectively shoulders on the crystal, cooperating with the bezel and caseback respectively, to provide a water-resistant seal.

Figure 1:
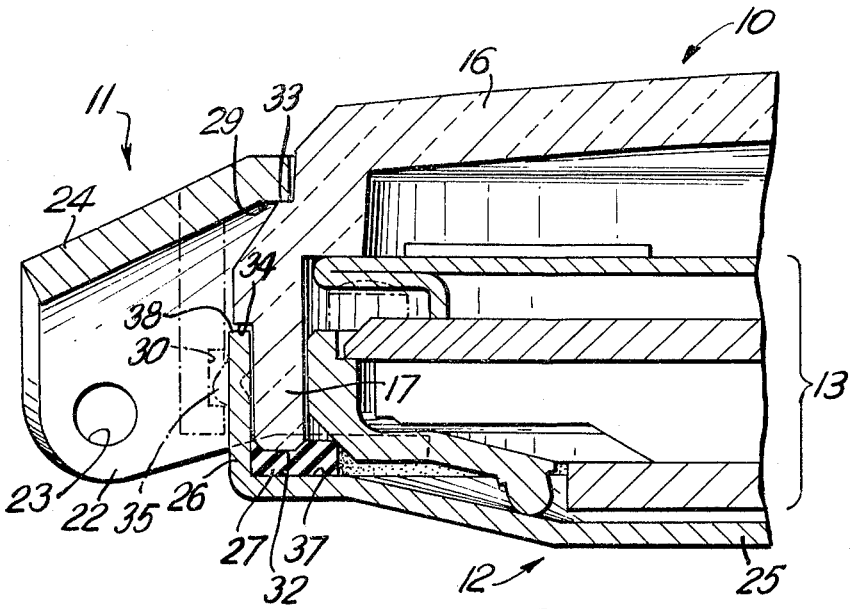
FIGS. 1 and 2 are enlarged elevation cross-sectional drawings of portions of the watch case assembly, taken along lines through the bezel lug section, and through the pendant and crown section respectively, in a wristwatch.
Figure 2:
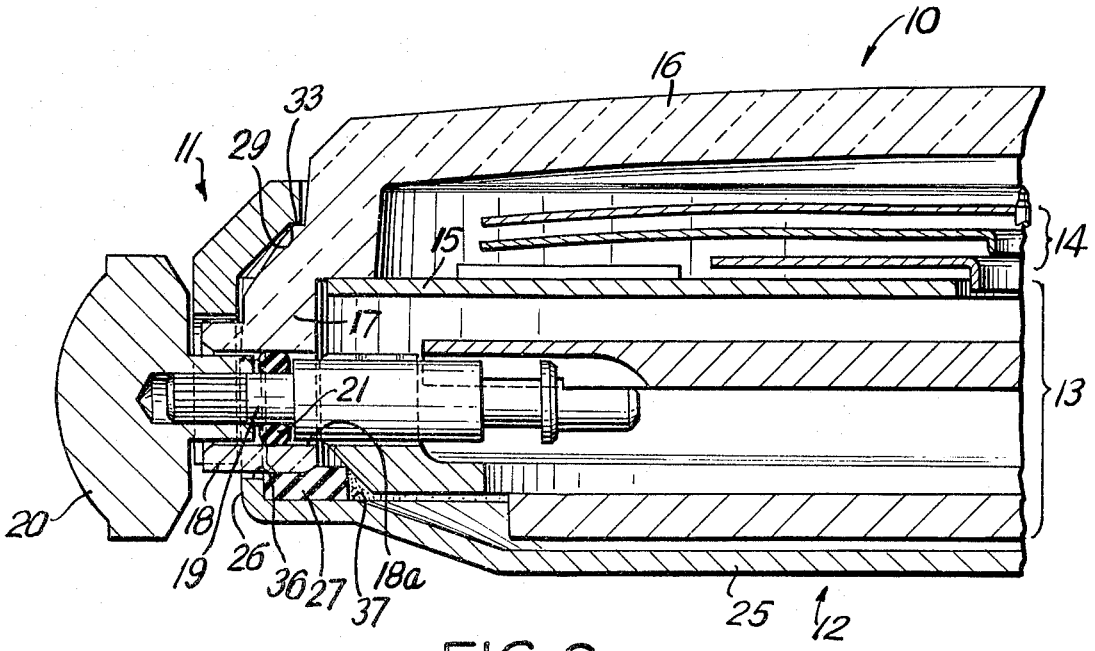

Referring now to FIGS. 1 and 2 of the drawing, the assembly of elements shown in both figures comprises a crystal 10, a bezel 11, and a caseback 12, enclosing a watch movement 13. The movement 13 is illustrated as a mechanical analog movement with hands 14 disposed above a dial 15 to tell the time. However, the type of movement 13 is not material to the present invention and could equally be a solid state digital timepiece module of a type well known in the art.

Crystal 10 includes a central viewing portion 16 and an integral depending wall portion 17. As shown in FIG. 2, the wall portion 17 incorporates an integral projecting pendant 18 with cylindrical hole **18*a* for receiving a conventional winding and setting stem 19 attached to the watch crown 20. An "O" ring 21 provides a seal between stem 19 and hole 18*a*** in the pendant.

Bezel 11 surrounds and generally conforms to the outside of the walls 17 of the crystal and, in the present invention, is preferably a thin shell-type metal member of decorative finish and construction to give the appearance of a stainless steel outer case. As shown in FIG. 1, which is a cross section through the lug section used for attachment to a watch band or strap, bezel 11 has a pair of projecting spaced ears 22 with holes 23 to receive conventional spring bars, the ears being joined by a shelf or cover 24. Another pair of such ears (not shown) are on the opposite side of the case. These provide a pair of covered attachment lugs for a conventional strap or band.

The caseback 12 has a flat central portion 25 joined to a peripheral wall portion 26 which surrounds and generally conforms to the shape of the lower end of the depending crystal wall 17.

Lastly, a gasket 27 is disposed between the crystal and the caseback adjacent the caseback peripheral portion. Note that the caseback and gasket are non-circular (see FIG. 7).

Figure 3:
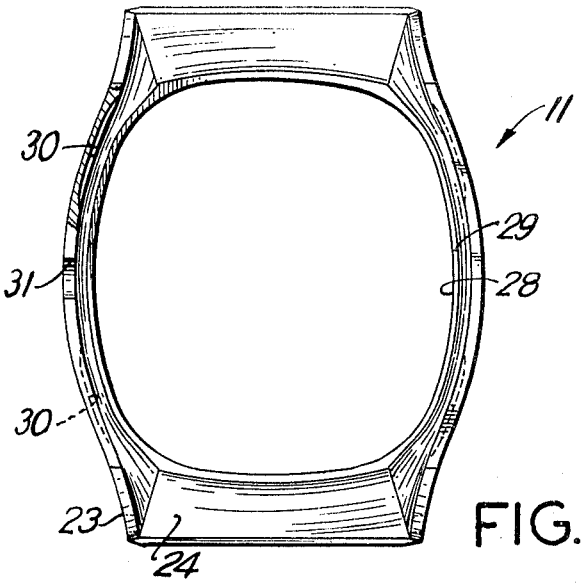
FIG. 3 and FIG. 4 are bottom plan view and horizontal elevation view respectively of the bezel.
Figure 4:
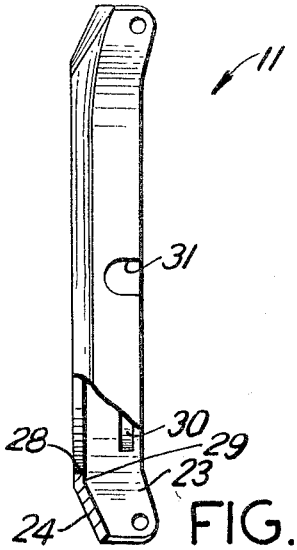

Further details of the bezel 11 may be seen by reference to FIGS. 3 and 4. FIG. 3 is a view from the bottom or underside of the bezel indicating that it is a shell or metal stamping. The bezel is preferably of relatively thin stainless steel material on the order of 0.75 mm in uniform thickness and has a central opening 28 which provides a peripheral clamping ledge 29. At four spaced locations, recessed grooves 30 in the wall (see also FIG. 1) provide means to snap-fit the bezel to the caseback. A slot 31 in the lower wall is provided to fit over the pendant 18 (see also FIG. 2).

Figure 5:
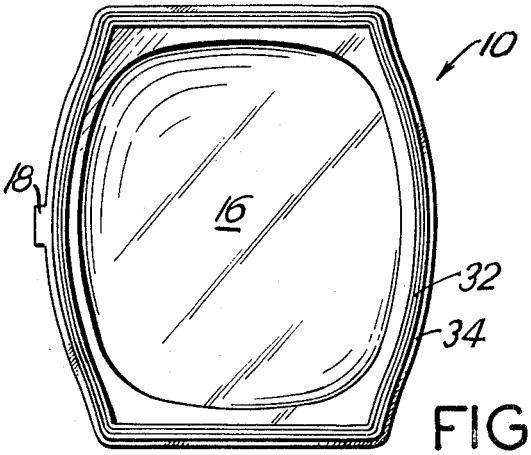
FIG. 5 and FIG. 6 are bottom plan view and horizontal elevation view respectively of the wristwatch crystal.
Figure 6:
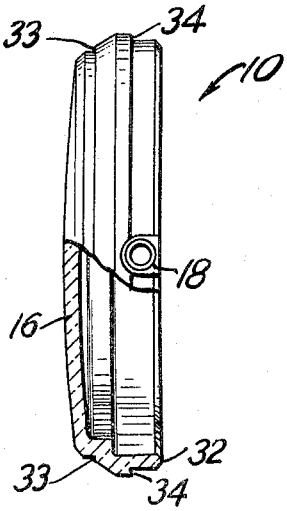

Reference to FIGS. 5 and 6 shows details of the crystal 10. FIG. 5 is a plan view from the underside of the crystal showing that it is non-circular for aesthetic reasons (although it could also be circular) and has a central viewing portion 16 and integral pendant 18. A continuous peripheral rim 32 (see also FIG. 1) provides a first sealing surface for clamping with the gasket 27. Reference to FIG. 6 shows the crystal wall 17 is provided with a peripheral axially-facing clamping shoulder 33 and a peripheral axially-facing movement-limiting shoulder 34 directed in the opposite direction. (see also FIGS. 1 and 2).

Figure 7:
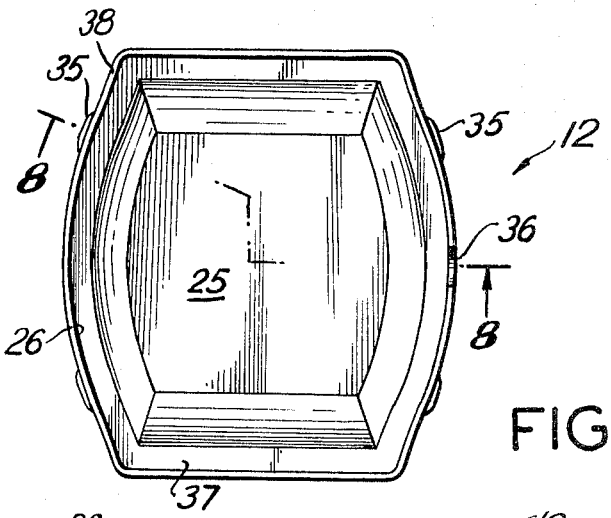
FIGS. 7 and 8 are top plan view and horizontal sectional view respectively of the caseback.
Figure 8:
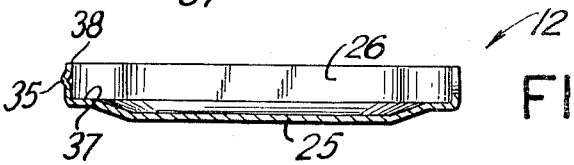

Reference to FIGS. 7 and 8 shows details of the caseback 12, this being of a non-circular shape conforming generally to the lower wall of the crystal and formed of a thin sheet metal stamping. FIG. 7 is a plan view looking down into the caseback showing the central portion 25 and peripheral wall 26. At four spaced locations corresponding to the aforementioned slots 30 in the bezel, projecting lugs or bumps 35 are provided to snap into the aforementioned grooves. A slot 36 in wall 26 provides clearance for the pendant. A peripheral sealing surface 37 adjacent the wall 26 in the caseback provides a second sealing surface for clamping against the gasket 27. The caseback wall has a rim 38 directed upwardly toward the movement-limiting shoulder 34 of the crystal. See also FIG. 1 which shows that dimensions are selected so that close clearance between rim 38 and shoulder 34 is provided.

OPERATION

Operation of the invention should now be apparent by reference to the drawings of FIGS. 1 and 2. The water-resistant enclosure for movement 13 is provided by means of crystal 10 and caseback 12 with the gasket 27 clamped between the rim 32 of the crystal and sealing surface 37 of the caseback. Contrary to some prior art constructions, where the seal is provided by radially outward pressure on the depending crystal wall which can lead to stresses on unsupported portions, the clamping action is in an axial direction against a continuous peripheral rim of the crystal wall.

The clamping force is obtained by cooperative action between the bezel, caseback and crystal. Downward pressure on the crystal clamping shoulder 33 is provided by the ledge 29 on the bezel and upward force is applied on the caseback against the resistance of the gasket 27 until the bumps 35 on the caseback snap into grooves 30 in the bezel wall with a snap fit. Further movement of the crystal and caseback toward one another are controlled by cooperation between the movement-limiting shoulder 34 and its clearance with the top rim 38 of the caseback wall 26. This dimension is carefully controlled with respect to the shape of the snap-fit projections between caseback and bezel and with respect to the desired compression on gasket 27. All of the stresses applied to the crystal wall are in an axial direction and uniformly applied around the periphery of the shaped crystal to reduce the likelihood of cracks or other damage from high stress and to assure uniform sealing with the gasket. The plastic material of the crystal provides an inexpensive portion of a major part of the housing, while the clamping or mechanical forces are accomplished using a thin but strong decorative shell, preferably of a material such as stainless steel which is also corrosion resistant.

While the snap-fit arrangement between bezel and caseback have been shown with bumps on the caseback and grooves in the bezel, the snap-fit could be accomplished by many other well-known means, including reversal of the bumps and grooves in the respective members or by using intermediate connecting members, many of such equivalent snap-fit arrangements being shown in the prior art, such as the cited Sakalys patent.

While there has been described what is considered to be the preferred embodiment of the invention, other modifications will occur to those skilled in the art, and it is desired to secure in the appended claims all such modifications as fall within the true spirit and scope of the invention.

We claim:

1. In a wristwatch of the type having a bell-shaped crystal with a central viewing portion and an integral depending wall with an integral pendant, a bezel of thin substantially uniform wall thickness surrounding and generally conforming to portions of the crystal wall, and a caseback having a central portion and a peripheral wall surrounding and generally conforming to portions of the crystal wall, the improvement comprising:

a peripheral clamping shoulder on the crystal cooperatively associated with a clamping ledge on said bezel, snap-fit attachment means between the bezel and the case back wall, a gasket disposed between first and second sealing surface defined by spaced portions of the crystal and caseback, whereby said gasket is compressed by being urged toward the gasket by the bezel acting on said clamping shoulder and retained by said snap-fit attachment between the bezel and the caseback, said crystal further including a movement-limiting shoulder defined on the crystal and adapted to cooperate with portions of the caseback to limit movement of the crystal toward the caseback and thereby control the spacing between said first and second sealing surfaces.

2. The improvement according to claim 1, wherein said crystal is a non-circular transparent plastic molding and having said clamping shoulder and said movement-limiting shoulder defined by oppositely-directed axially-facing surfaces on the wall portion of said crystal.

3. The improvement according to claim 1, wherein the lower rim of the wall portion of said crystal comprises said first sealing surface, and wherein the caseback defines said second sealing surface adjacent the caseback wall portion, said gasket and said sealing surfaces being of a non-circular shape.

4. The improvement according to claim 1, wherein said bezel is of stainless steel and includes oppositely directed pairs of spaced ears connected by a shelf, together forming covered attachment lugs.

5. The improvement according to claim 1, wherein said bezel comprises a stainless steel shell having a plurality of peripherally spaced grooves in the bezel wall, and wherein the caseback wall includes a plurality of peripherally spaced bumps adapted to cooperate with said bezel grooves to provide a snap-fitting attachment.

6. The improvement according to claim 1, wherein said movement limiting shoulder is adapted to cooperate with the rim of the wall portion of the caseback, and wherein said gasket is disposed between first and second sealing surfaces defined by the rim of the wall portion of the crystal and an inner peripheral surface of the caseback respectively.

7. In a wristwatch of the type having a bell-shaped non-circular crystal of a transparent plastic molding having a central viewing portion and a depending wall with an integral pendant, a thin metal bezel member of stainless steel surrounding and conforming to portions of the crystal wall, and a metal caseback member having a central portion and a peripheral wall, the improvement in said wristwatch case comprising:

oppositely-directed, axially-facing clamping and movement-limiting shoulders, respectively, defined on the crystal wall, said movement-limiting shoulders adapted to cooperate with portions of the caseback to limit movement of the crystal toward the caseback, said caseback wall being shaped to conform to and overlap the crystal wall portion about its periphery and having its end disposed with close clearances with respect to said movement-limiting wall portion, a gasket disposed between the rim of the peripheral crystal wall portion and an inner peripheral surface of the caseback member, a clamping ledge defined by the bezel member and abutting said clamping shoulder on the crystal, and snap-fit attachment means between the bezel member and the caseback member, comprising a plurality of cooperating spaced grooves in the wall of one of said members and cooperating spaced bumps on the wall of the other of said members.

* * * * *